US006412451B2

(12) United States Patent
Kuga et al.

(10) Patent No.: US 6,412,451 B2
(45) Date of Patent: Jul. 2, 2002

(54) COOLING WATER CIRCULATING STRUCTURE IN INTERNAL COMBUSTION ENGINE

(75) Inventors: Shinji Kuga; Yuichi Moriyama, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/773,601

(22) Filed: Feb. 2, 2001

(30) Foreign Application Priority Data

Feb. 3, 2000 (JP) ..... 2000-026399

(51) Int. Cl.[7] ..... F01P 3/02
(52) U.S. Cl. ..... 123/41.72
(58) Field of Search ..... 123/41.72, 41.82 R

(56) References Cited

U.S. PATENT DOCUMENTS 5,076,217 A * 12/1991 Clough ..... 123/41.74
5,269,243 A * 12/1993 Mochizuki ..... 123/305

* cited by examiner

*Primary Examiner*—Marguerite McMahon
*Assistant Examiner*—Hyder Ali
(74) *Attorney, Agent, or Firm*—Birch, Stewart, Kolasch & Birch, LLP

(57) ABSTRACT

A cooling water circulating structure in an internal combustion engine is to be provided wherein cooling water can flow to every corner through a water jacket in a cylinder block and a water jacket in a cylinder head without being localized and thereby can cool the whole efficiently and which permits an easy layout of the water piping. A cooling water circulating structure in a multi-cylinder type internal combustion engine wherein a cooling water inlet and a cooling water outlet are formed side by side respectively in a side face of a cylinder block and a side face of a cylinder head both on the same side of the internal combustion engine close to a water pump, and a cylinder block-side water jacket and a cylinder head-side water jacket are brought into communication with each other through communication paths and are formed on the side opposite to the side close to the water pump, thereby allowing cooling water to circulate.

8 Claims, 8 Drawing Sheets

COOLING WATER CIRCULATING STRUCTURE IN INTERNAL COMBUSTION ENGINE

BACKGROUND OF THE INVENTION

1. Field of the Invention

The present invention relates to a cooling water circulating structure in an internal combustion engine.

2. Description of Background Art

A conventional cooling water circulating structure in a multi-cylinder type internal combustion engine is illustrated in FIG. 11. FIG. 11 illustrates a cooling water circulating structure as disclosed in JP-A No. H3-225015.

An internal combustion engine 01 is provided with a cooling water inlet 02*a* in one side face of a cylinder block 02 and a cooling water outlet 03*a* in a side face of a cylinder head 03 on the side opposite to the cooling water inlet 02*a*. Cooling water which has been fed, by means of a cooling water pump 04, to the cooling water inlet 02*a* formed in one side face of the internal combustion engine 01 passes through a water jacket 02*b* provided within the cylinder block 02 and flows into a water jacket 03*b* provided within the cylinder head 03, then flows out from the cooling water outlet 03*a* formed in the other side face of the internal combustion engine 01 to cool both cylinder block 02 and cylinder head 03.

The cooling water flowing out from the cooling water outlet 03*a* in the cylinder head 03 and having a high temperature is conducted to a radiator 05, in which it is cooled, then the cooling water thus cooled flows again into the internal combustion engine 01. Generally, such a cooling water circulating route as described above is concentional.

A review of the cooling water flow from the cooling water inlet 02*a* to the cooling water outlet 03*a* in the internal combustion engine 01 shows that the cooling water easily flows into a cooling water path which is close to a straight line L joining the cooling water inlet 02*a* and the cooling water outlet 03*a* and that running water in a cooling water flow path away from the straight line L becomes less powerful and this phenomenon is more conspicuous as the distance from the straight line L becomes longer, thus making the cooling water difficult to flow.

It follows that the cooling water outlet 03*a* side of the cylinder block 02 and the cooling water inlet 02*a* side of the cylinder head 03 are inferior in cooling effect as compared with a central portion and the portion around the central portion.

Moreover, since the cooling water inlet 02*a* and the cooling water outlet 03*a* in the internal combustion engine 01 are provided in side faces opposite to each other, it is not easy to effect the layout of the water piping.

In the foregoing JP-A No. H3-225015 there is described an example in which a cooling water flow path in the cylinder block and a cooling water flow path in the cylinder head are separated from each other. In this example, however, a pair of cooling water inlet and cooling water outlet are formed in each of the cylinder block and the cylinder head and in side faces opposite to each other, with the result that water piping becomes complicated and the layout thereof becomes more difficult.

SUMMARY AND OBJECTS OF THE INVENTION

The present invention has been accomplished in view of the above-mentioned point and it is an object of the invention to provide a cooling water circulating structure in an internal combustion engine wherein cooling water reaches every corner through a cylinder block and a cylinder head without being localized, thereby permitting efficient cooling of the whole, and which permits easy layout of water piping.

For achieving the above-mentioned object, according to a first embodiment of the invention, there is provided a cooling water circulating structure in an internal combustion engine wherein a cooling water inlet and a cooling water outlet are formed side by side in a side face of a cylinder block and a side face of a cylinder head, respectively, in a multi-cylinder type internal combustion engine, both the side faces lying on the same side of the internal combustion engine close to a water pump, and a cylinder block-side water jacket and a cylinder head-side water jacket are communicated with each other through a communication path formed on the side opposite to the side close to the water pump, thereby allowing cooling water to circulate.

Cooling water admitted from the cooling water inlet flows through the cylinder block-side water jacket (or the cylinder head-side water jacket) from one side to the opposite side, then on the opposite side the cooling water passes through the communication path and flows into the cylinder head-side water jacket (or the cylinder block-side water jacket), and flows through the cylinder head-side water jacket (or the cylinder block-side water jacket) toward the one side.

Thus, the cooling water reaches every corner in both cylinder block and cylinder head-side water jackets without being localized, thereby permitting efficient cooling of the whole.

Besides, since the cooling water inlet and outlet are provided on the same side close to a water pump, the layout of water piping is easy.

According to a second embodiment of the invention, there is provided, in combination with the first aspect, a cooling water circulating structure in an internal combustion engine wherein cylinders arranged in a crank shaft direction of the multi-cylinder type internal combustion engine are largely tilted forward, and the cooling water outlet is formed in a corner portion located at the highest position of the cylinder head-side water jacket.

When the cooling water admitted into the cylinder head-side water jacket (or the cylinder block-side water jacket from the communication path flows toward the cooling water outlet located on the opposite side, since the cooling water outlet lies in the highest corner portion of the cylinder head-side water jacket (or the cylinder block-side water jacket), the cooling water prevails substantially throughout the whole of the interior of the cylinder head-side water jacket (or the cylinder block-side water jacket) and thereafter flows out from the cooling water outlet which is located at a high position, whereby the whole of the cylinder head (or the cylinder block) can be cooled efficiently.

According to a third embodiment of the invention, there is provided, in combination with the first and second aspects, a cooling water circulating structure in an internal combustion engine wherein at least one of the cylinder block-side water jacket and the cylinder head-side water jacket is provided with a flow controlling wall which conducts cooling water substantially in a crank shaft direction.

By disposing the flow controlling wall at an appropriate position it is possible to conduct the cooling up to a portion in the water jacket concerned where the cooling water is difficult to prevail and hence possible to prevent localizing of the cooling water, thus permitting the whole of the internal combustion engine to be cooled efficiently.

Besides, the rigidity of the cylinder head or the cylinder block can be enhanced by the flow controlling wall.

According to a fourth embodiment of the invention there is provided, in combination with any of the first to third aspects, a cooling water circulating structure in an internal combustion engine wherein an auxiliary communication path for communication between the cylinder block-side water jacket and the cylinder head-side water jacket is provided separately from the foregoing communication path.

By disposing the auxiliary communication path in a portion within the water jacket located on the cooling water influent side from the communication path in which portion the cooling water is difficult to prevail or apt to stay, it is possible to let the cooling water reach every corner in the water jacket smoothly and hence possible to effect efficient cooling of the whole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
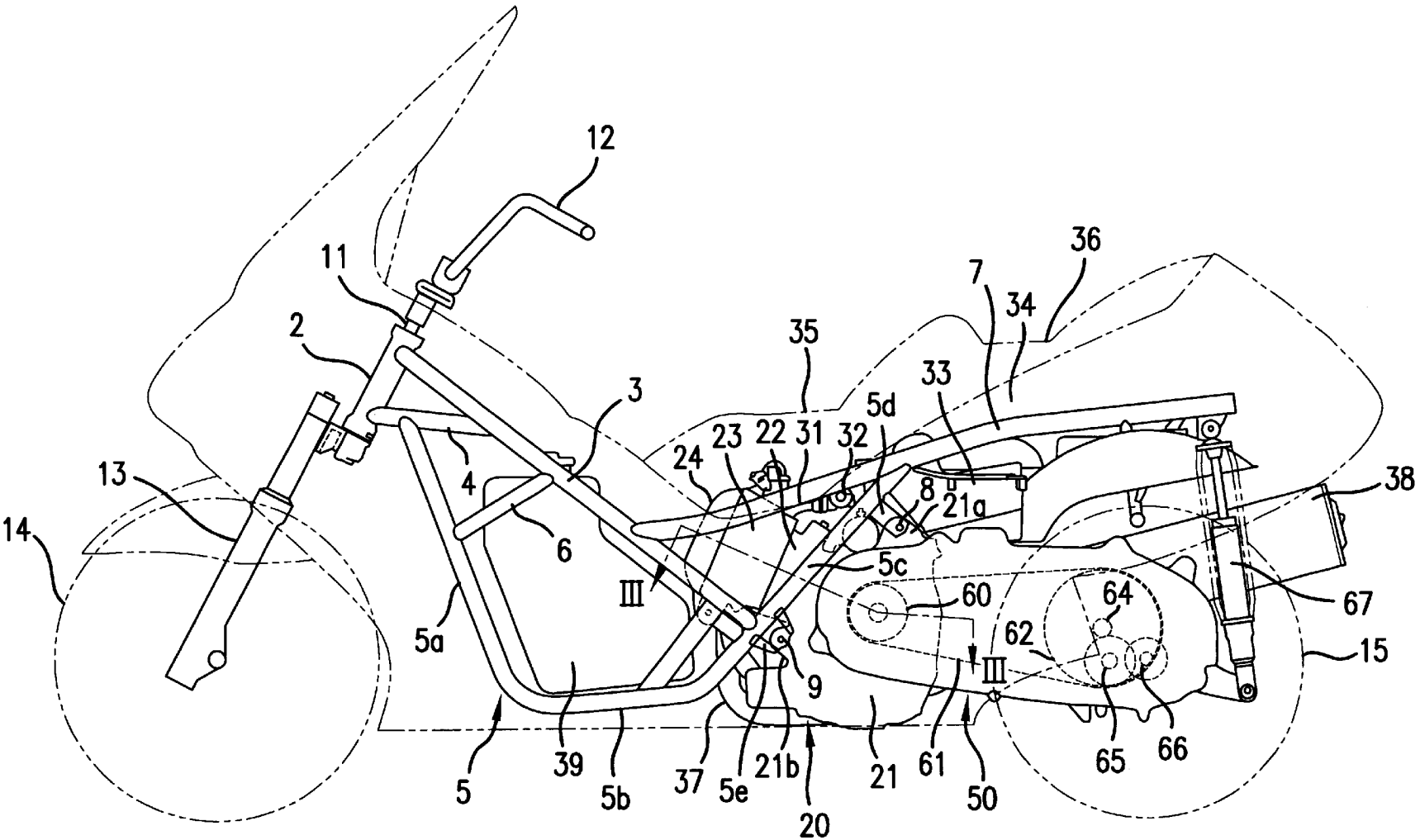
FIG. 1 is a side view showing the whole of a scooter type motorcycle to which an internal combustion engine according to an embodiment of the present invention is applied.

An embodiment of the present invention will be described hereinunder with reference to FIGS. 1 to 8. An internal combustion engine related to this embodiment is applied to a scooter type two-wheeled motor vehicle, or a motorcycle 1 the whole of which is illustrated as a side view in FIG. 1.

A body frame of the motorcycle 1 comprises a head pipe 2, a pair of main pipes 3 extending obliquely downwardly and backwardly from an upper portion of the head pipe 2 in a rectilinear form in side view, and a pair of right and left support pipes 4 extending backwardly substantially horizontally from a lower portion of the head pipe 2 and connected to the main pipes 3 to support front portions of the main pipes 3.

Further, a pair of right and left down-pipes 5 extend transversely and downwardly at an acute inclination angle from intermediate positions of the support pipes 4, affording a pair of front vertical portions 5*a*. At lower ends of the front vertical portions 5*a* the down-pipes 5 are bent backwardly to form a pair of central horizontal portions 5*b*, then at rear ends of the central horizontal portion 5*b* the down-pipes 5 are bent upwardly to form a pair of rear inclined portions 5*c*.

Rear ends of the main pipes 3 are connected to lower portions of the rear inclined portions 5*c*, and a reinforcing pipe 6 is interposed between each main pipe 3 and each down-pipe 5 both of which define a generally triangular shape in side view.

A pair of seat rails 7 are fixed at front ends thereof to the main pipes 3 in somewhat rear positions with respect to middle positions of the main pipes and extend slightly obliquely upwardly and backwardly in a nearly horizontal state up to a rear portion of the vehicle body. Upper ends of the rear inclined portions 5*c* of the down-pipes 5 are connected to middle positions of the seat rails 7 to support the seat rails from below.

The head pipe 2 supports a steering shaft 11 and a pair of handlebars 12 are mounted on the steering shaft 11 and extend right and left. Extending downwardly from the steering shaft is a front fork 13, with a front wheel 14 being supported through an axle by lower ends of the front fork 13.

Support brackets 5*d* and 5*e* project backwardly from upper and lower positions respectively of the rear inclined portions 5*c* of the down-pipes 5 and an internal combustion engine 20 is suspended inside the support brackets 5*d* and 5*e* each making a pair right and left.

In the internal combustion engine 20, which is a four-cycle two-cylinder type internal combustion engine, a crank case 21 is positioned behind the rear inclined portions 5*c* of the down-pipes 5, and a cylinder block 22, a cylinder head 23, and a cylinder head cover 24, which are successively stacked and combined in the crank case 21, project forwardly with respect to the rear inclined portions 5*c* in a greatly forwardly inclined posture.

When seen in side view, the cylinder block 22, cylinder head 23, and cylinder head cover 24 are positioned between right and left triangles defined by the rear inclined portions 5*c* of the right and left down-pipes 5, rear portions of the main pipes 3 and front portions of the seat rails 7. A mounting bracket 21*a* projects from an upper portion of the crank case 21 and a mounting bracket 21*b* projects from a front portion of the crank case, as seen in side view, are supported respectively by the support brackets 5*d* and 5*e* through support shafts 8 and 9, whereby the internal combustion engine 20 is suspended on the vehicle body frame.

A belt type automatic transmission 50 is pivotally connected at a front portion thereof to the crank case 21 of the internal combustion engine 20 and extends backwardly, with a rear wheel 15 being supported through an axle by a rear portion of the automatic transmission 50.

A pair of intake pipes 31 extend upwardly respectively from the cylinders in the forwardly inclined cylinder head 23 of the internal combustion engine 20, then are curved backwardly and are connected respectively to a pair of carburetors 32 which are juxtaposed right and left on the crank case 21 and which are connected to an air cleaner 33 disposed behind them.

The air cleaner 33 is disposed between the right and left seat rails 7, and above the air cleaner 33 is supported to be suspended a helmet container box 34 on the seat rails 7.

A rider seat 35 covers the internal combustion engine 20 and the carburetors 32 from above so that it can be opened and closed, while a seat 36 for a fellow passenger covers the helmet container box 34 and the portion behind the container box from above so that it can be opened and closed.

A pair of exhaust pipes 37 extending downwardly from the cylinder head 23 deviate to the right-hand side in front of the crank case 21 and extend backward along the right side face of the crank case, then are combined into a single pipe, which pipe then rises obliquely upward from the right-hand side of the vehicle body and is connected to a muffler 38, the muffler 38 being supported on the right-hand side of the rear wheel 15.

In front of the internal combustion engine 20 is supported to be suspended a fuel tank 39 while being surrounded by a total of four pipes which are two right and left upper main pipes 3 and two right and left down-pipes 5 extending downwardly from the front side.

The scooter type motorcycle 1 is roughly constructed as above.

A description will be given below about the structure of the belt type automatic transmission 50 connected pivotally to the crank case 21 of the internal combustion engine 21.

Figure 3:
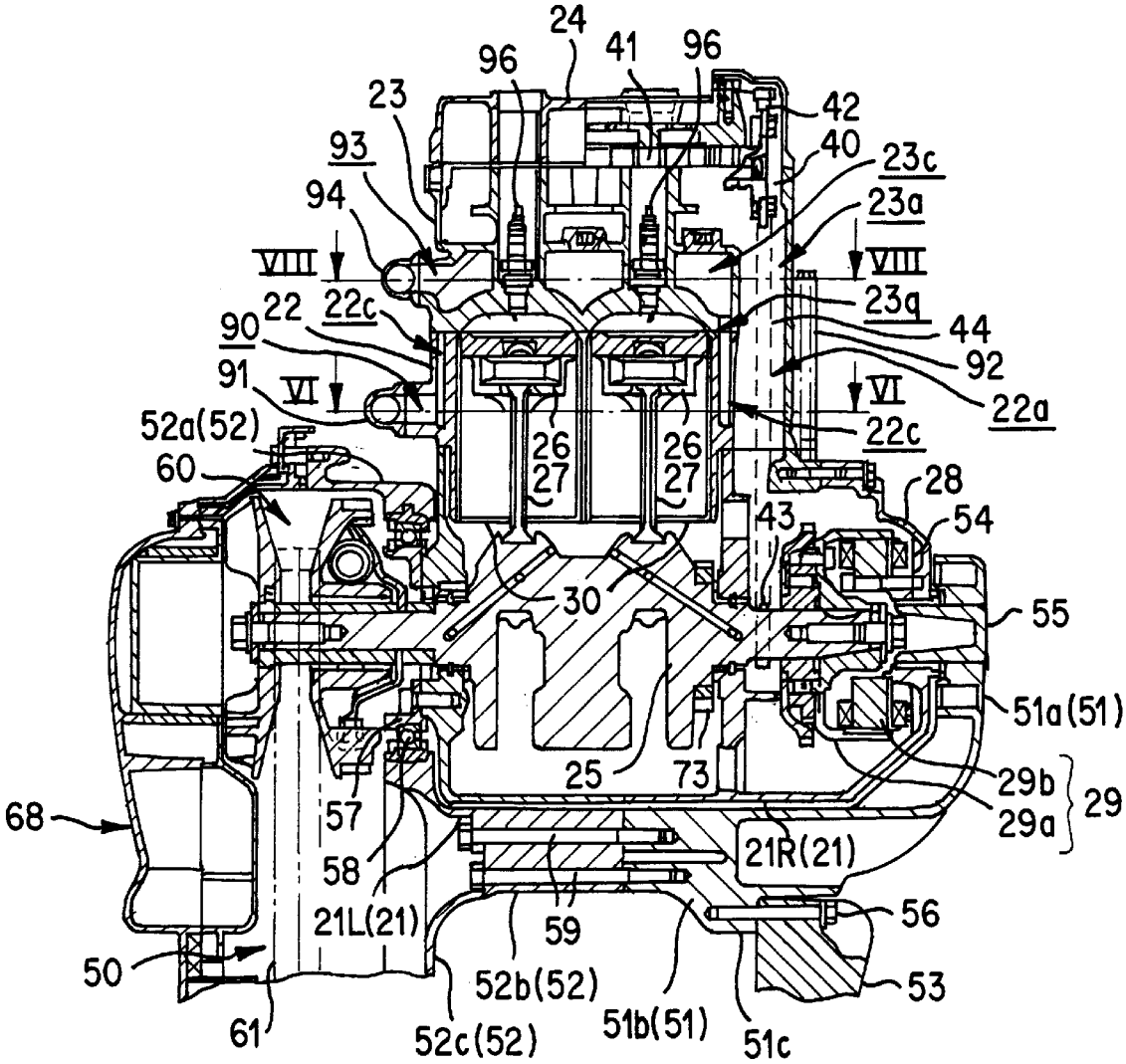
FIG. 3 is a sectional view taken along line - in FIGS. 1 and 2.
Figure 4:
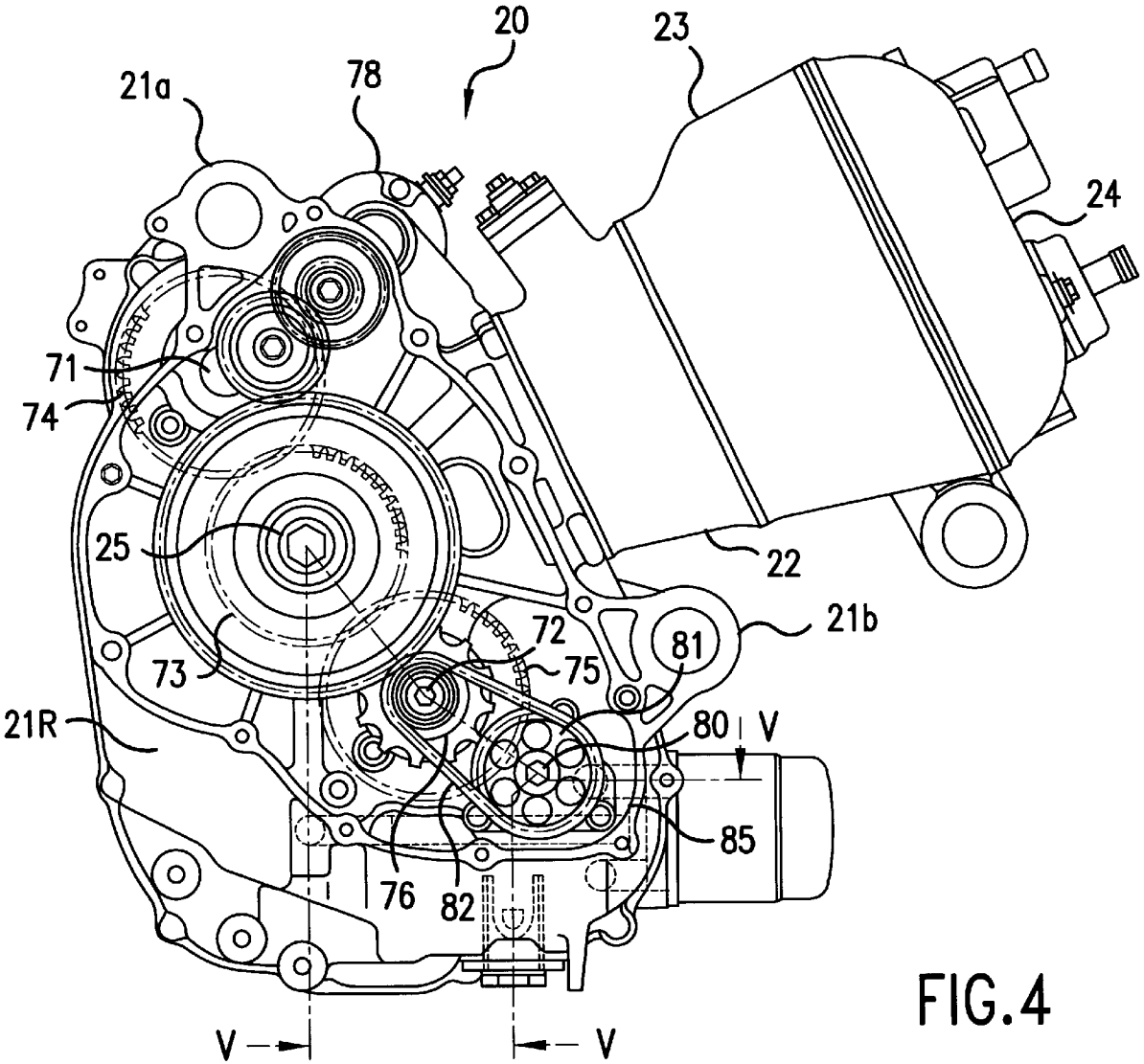
FIG. 4 is a partially omitted left side view of the internal combustion engine.

The crank case 21 is constituted by combining left and right crank cases 21L, 21R. As shown in FIG. 3, a crank shaft 25 extends right and left horizontally within the crank case 21 and an outer rotor 29*a* of an AC generator 29 is fitted on a right-hand end of the crank shaft 25 and is sideways covered with a case cover 28 which is fixed to the right-hand crank case 21R. An inner stator 29*b* of the AC generator 29 is supported by the case cover 28.

Pistons 26 adapted to reciprocate respectively within two cylinder sleeves 30 in the cylinder block 22 are connected to crank pins of the crank shaft 25 through a pair of connecting rods 27.

A valve operating mechanism 40 is provided in the cylinder head 23 and a timing chain 44 is mounted to be suspended between a pair of cam chain sprockets 42 and a driving chain sprocket 43 to effect power transfer, the cam chain sprockets 42 being fitted on right-hand ends of two upper and lower cam shafts 41 which extend right and left horizontally, the driving chain sprocket 43 being fitted on a base portion of the crank shaft 25 projecting from the right-hand crank case 21R.

The timing chain 44 passes through cam chain chambers 22*a* and 23*a* which are formed on the right-hand side of the cylinder block 22 and the cylinder head 23, respectively.

The cam shafts 41 actuate an intake valve 45 and an exhaust valve 46, respectively, at a predetermined time.

The belt type automatic transmission 50 is pivotally connected to the crank case 21 of the internal combustion engine 20.

A case cover 26 closes a right-hand opening of the right-hand crank case 21R and covers an AC generator 27.

The case cover 26 has an opening coaxial with the crank case 25, and a rotary shaft 55 projects rightwardly from the opening through a bearing 54. Further, a base end portion 51*a* of a right-hand transmission case 51 of the belt type automatic transmission 50 is fitted on the projecting shaft portion (see FIG. 9).

The right-hand transmission case 51 has a connector portion 51*b* extending inwards from the base end portion 51 a along a rear side of the right-hand crank case 21R.

Mounting boss portions 51*c* project rearwardly from a rear side of the connector portion 51*b* at two upper and lower positions. A left-hand mating surface at a front end of a right-hand fork member 53 is registered with a right-hand mating surface of the mounting boss portion 51*c* and, by threadedly fitting bolts 56 at the two upper and lower positions into the right-hand fork member 53 and the right-hand transmission case 51 to connect both integrally with each other in a rearwardly extending state of the right-hand fork member.

On the other hand, a left end of the crank shaft 25 passes through the left-hand crank case 21L and projects leftwards and a driving pulley 60 provided with a speed change mechanism is mounted on the projecting portion of the crank shaft.

An annular support member 57 is fixed to an outer surface of the left-hand crank case 21L through which the crank shaft 25 extends, the annular support member 57 being fixed around the crank shaft 25 on the outer surface.

Further, a base end portion 52*a* of the left-hand transmission case 52 is pivotably connected to the annular support member 57 through a bearing 58.

The left-hand transmission case 52 has a connector portion 52*b* and a rearwardly extending left-hand fork portion 52*c*, the connector portion 52*b* extending inwardly along a rear side of the left-hand crank case 21L.

A mating surface of the connector portion 51*b* of the right-hand transmission case 51 extends inwardly from the right-hand side along the rear surface of the crank case 21 and a mating surface of the connector portion 52*b* of the left-hand transmission case 52 extending inwardly from the left-hand side along the crank case rear side are brought into abutment against each other and the left- and right-hand transmission cases 51, 52 are integrally connected together using four bolts 59 so that the left-hand fork portion 52*c* and the right-hand fork member 53 are opposed to each other.

The right-hand transmission case 51 as one of the thus-interconnected transmission cases is supported so as to be pivotable about the shaft 25 by means of the bearing 54 and the left-hand transmission case 52 as the other transmission case is supported so as to be pivotable about the crank shaft 25 by means of the bearing 58. Consequently, the left-hand fork portion 52*c* and the right-hand fork member 53 are opposed to each other and are supported vertically pivotably about the crank shaft 25.

A rear portion of the left-hand fork portion 52*c* of the left-hand transmission case 52 defines a transmission chamber, in which a driven shaft 64 is supported rotatably, with a driven pulley 62 being mounted on the driven shaft 64 through a centrifugal clutch.

A V belt 61 is mounted to be suspended between the driven pulley 62 and the driving pulley 60 to constitute a belt type automatic speed change mechanism.

Within the transmission chamber defined in the rear portion of the left-hand fork portion 52*c* there is constituted a reduction mechanism by a group of gears through which a driving force is transmitted to an axle 66 from the driven shaft 64 via an intermediate shaft 65.

The axle 66 is mounted to be suspended between the left-hand fork portion 52*c* and the right-hand fork member 53, and the rear wheel 15 is supported by the axle 66 between the left-hand fork portion 52*c* and the right-hand fork member 53.

Thus, the left-hand and right-hand transmission cases 51, 52 which support the belt type transmission 50 are pivotally supported about the crank shaft 25 so that the left-hand fork portion 52*c*, right-hand fork member 53 and rear wheel 15 are pivotable vertically.

A rear cushion 67 is interposed between a rear end of the left-hand transmission case 52 and rear ends of the seat rails 7.

A left-hand opening of the left-hand transmission case 52 which accommodates the belt type transmission 50 is closed with a belt cover 68, which covers the belt type transmission 50 from the left-hand side.

The internal combustion engine 20 has a pair of balancer shafts 71 and 72 respectively above and below the crank shaft 25, and balancer driven gears 74 and 75, fitted respectively on the balancer shafts 71 and 72, are both in mesh with a driven gear 73 which is fitted on the crank shaft 25 along an inner surface of a bearing portion of the right-hand crank case 21R. With rotation of the crank shaft 25, the balancer shafts 71 and 72 rotate in directions opposite to each other.

The mounting bracket 21*a* is projectingly provided on the crank case 21 at a position just above the upper balancer shaft 71 and a starter motor 78 is disposed in front of the mounting bracket 21*a*. Thus, the three components, the starter motor 78, the mounting bracket 21*a* and the upper balancer shaft 71, are arranged adjacent to each other (see FIG. 4).

A pump driving shaft 80 is mounted to be suspended in parallel with the lower balancer shaft 72 at a lower and obliquely front position with respect to the lower balancer shaft. Further, a chain 82 is mounted to be suspended between a driving sprocket 76 fitted on a right-hand end of the lower balancer shaft 72 projecting from the right-hand crank case 21R and a driven sprocket 81 fitted on a right-hand end of the pump driving shaft 80 (see FIGS. 4 and 5).

Consequently, the rotation of the crank shaft 25 causes the pump driving shaft 80 to rotate through the balancer shaft 72.

An oil pump 85 is mounted on the pump driving shaft 80 at a position between the right-hand crank case 21R and the right-end driven sprocket 81, and a water pump 86 is mounted on a portion of the pump driving shaft 80 which portion projects from the left-hand crank case 21L.

Figure 2:
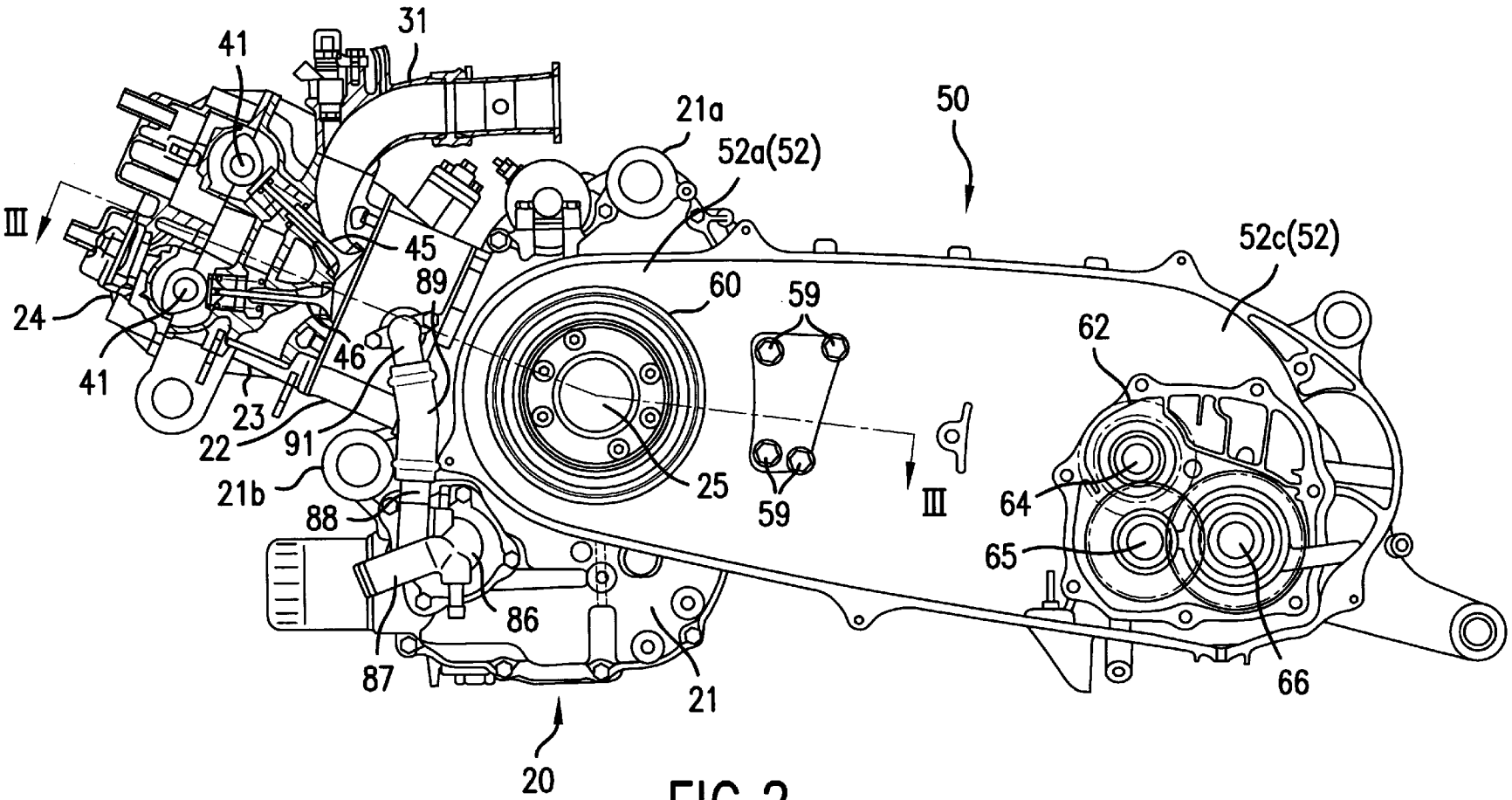
FIG. 2 is a partially sectional, partially omitted side view of the internal combustion engine and a belt type automatic transmission.
Figure 5:
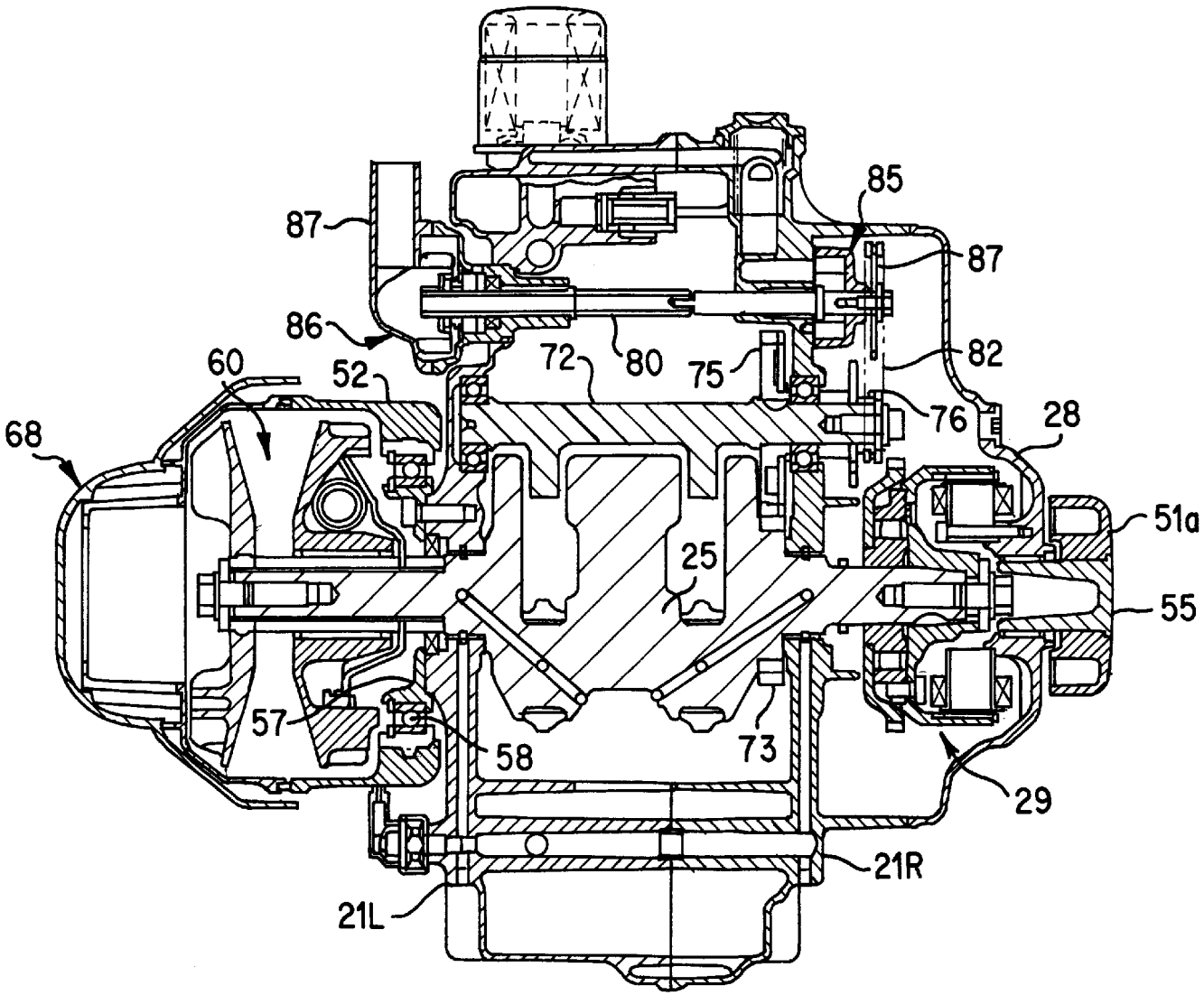
FIG. 5 is a sectional view taken along line V—V in FIG. 4.

A suction connector pipe 87 projects forward from a left-hand space in a central part of an impeller 86*a* of the water pump 86, as shown in FIG. 5, and a discharge connector pipe 88 projects upwardly from a side position of the impeller 86*a* (see FIG. 2).

The suction connector pipe 87 is connected to a radiator and, as shown in FIG. 2, the discharge connector pipe 88 is connected through a hose 89 to a connecting pipe 91 projectingly provided on a cooling water inlet 90 which is formed in a left side face of the cylinder block 22.

Since the cooling water inlet 90 is formed in the left side face of the cylinder block 22 lying on the same side as the left side face of the crank case 21 on which side is disposed the water pump 86, the connecting pipe 91 and the discharge connector pipe 88 are positioned close to each other and so that they can be connected together using the hose 89 which is a short hose.

Figure 6:
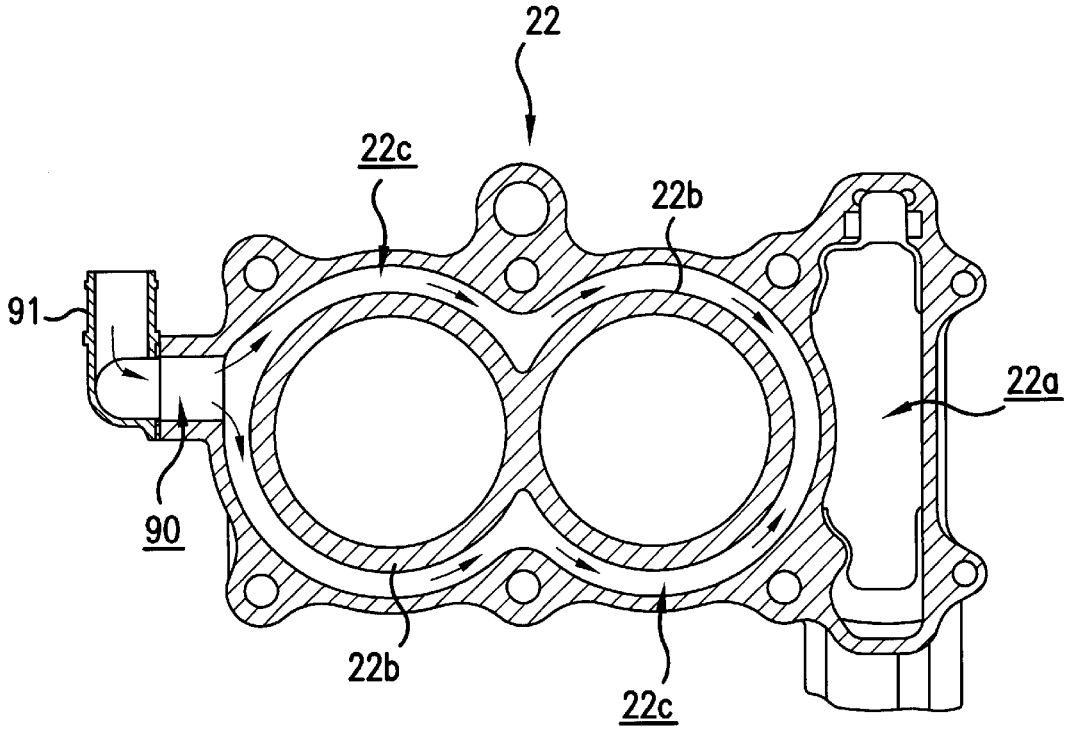
FIG. 6 is a sectional view of a cylinder block taken along line - in FIG. 3.

According to the structure of the cylinder block 22, as shown in FIG. 6 (a sectional view taken along line VI—VI in FIG. 3), a water jacket 22*c* is formed around an outer periphery of a cylinder inner wall 22*b* whose shape is like a joined shape of two cylinders.

This water jacket is a dry type jacket in which a cylinder sleeve 30 is fitted to the cylinder inner wall 22*b*.

Figure 7:
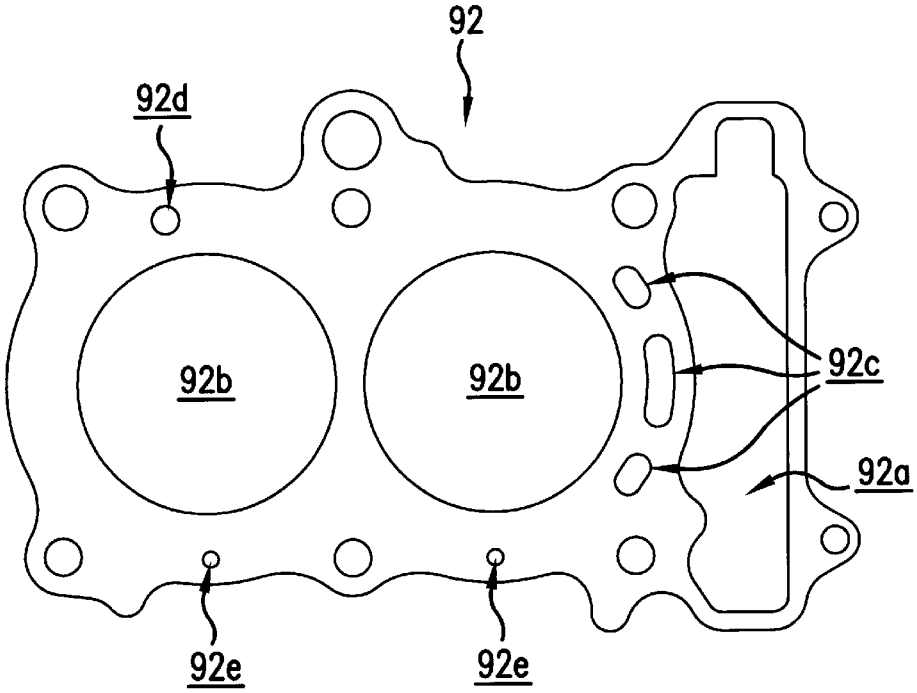
FIG. 7 is a plan view of a gasket.

As shown in FIG. 7, a gasket 92 interposed between joint surfaces of the cylinder block 22 and the cylinder head 23 has rectangular hole 92*a* for the cam chain chamber which hole 92*a* is formed on the right-end side in the same figure, and a pair of circular holes 92*b* are formed on the left-hand side of the hole 92*a* and in positions corresponding to two cylinder bores. The portion around the circular holes 92*b*, which portion corresponds to the water jacket 22*c*, is almost closed and three communication holes 92*c* are formed between the right-hand circular hole 92*b* and the rectangular hole 92*a*. Further, a single auxiliary communication hole 92*d* is formed below the left-hand circular hole 92*b* (this is true in actual mounting although the hole 92*d* is shown in an upper position in FIG. 7).

A pair of air vent holes 92*e* are formed above the circular holes 92*b*.

Figure 8:
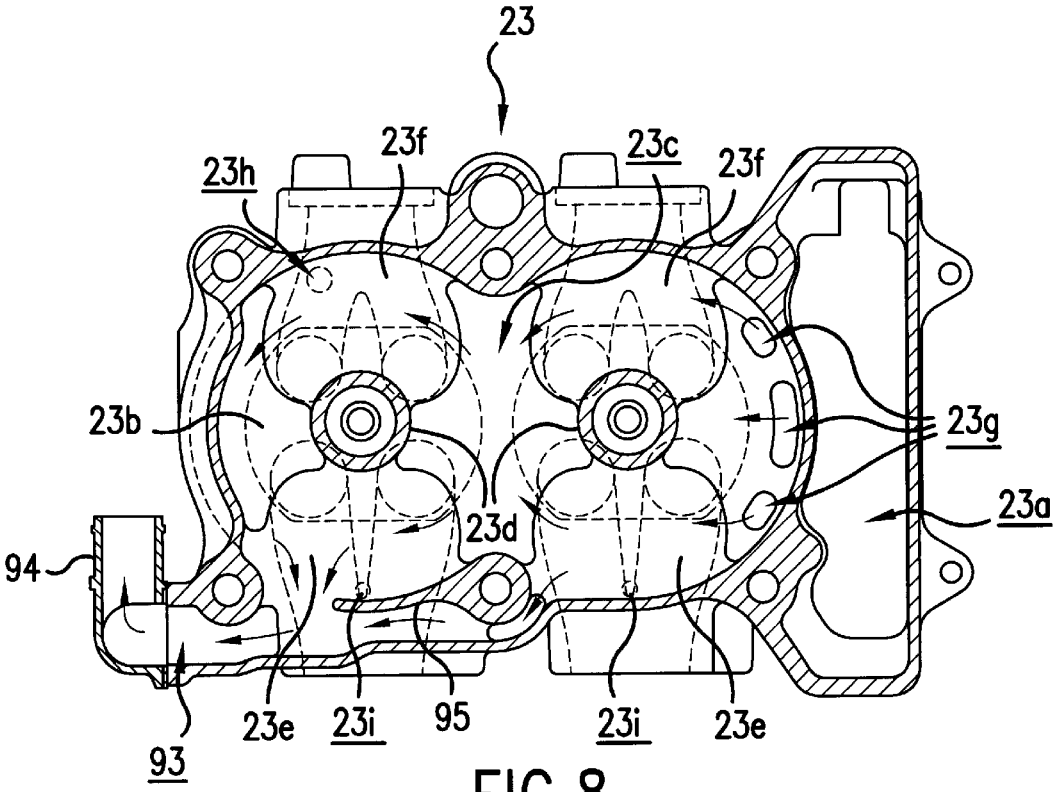
FIG. 8 is a sectional view of a cylinder head taken along line - in FIG. 3.

The structure of the cylinder head 23, which is joined to the cylinder block 22 through the gasket 92, is illustrated in FIG. 8 (a sectional view taken along line VIII—VIII in FIG. 3).

The cylinder head 23 has a ceiling wall 23*b* which defines recesses as combustion chambers, and a water jacket 23*c* is formed in a space above the ceiling wall 23*b* except a cylindrical portion 23*d* with spark plugs 96 fitted therein, intake passage walls 23*e* and exhaust passage walls 23*f*.

In a right-hand portion around the ceiling wall 23*b* are formed three communication holes 23*g* correspondingly to the communication holes 92*c* of the gasket 92. Likewise, an auxiliary communication hole 23*h* is formed correspondingly to the auxiliary communication hole 92*d* of the gasket 92 and air vent holes 23*i* are formed correspondingly to the air vent holes 92*e*.

A cooling water outlet 93 is formed in a corner portion on a left upper side (left lower side in FIG. 8) of the water jacket 23*c* and a connecting pipe 94 is projected from the cooling water outlet 93, with a radiator hose being connected to the connecting pipe 94.

Like the cooling water inlet 90, the cooling water outlet 93 is formed on the left side face of the cylinder head 23 which lies on the same side as the left side face of the crank case 21, so the water pump 86, cooling water inlet 90 and cooling water outlet 93 are together disposed on the left side face of the internal combustion engine 20, thus permitting an easy layout of the water piping.

A flow controlling wall 95 extends leftwards up to an intermediate position from an upper central part within the water jacket 23*c*, and between it and an upper outer wall of the cylinder head 23 is formed a flow path extending toward the cooling water outlet 93.

Such a cooling water circulation route is formed in both cylinder block 22 and cylinder head 23.

Therefore, cooling water discharged from the water pump 86 passes through the hose 89 and enters the water jacket 22*c* in the cylinder block 22 from the cooling water inlet 90 formed in the left side face of the cylinder block 22, then flows rightwards around the cylinder inner wall 22*b*, thereby cooling all of the cylinders (see the arrows in FIG. 6). The cooling water which has reached the right-hand side passes through the communication holes 92*c* and 23*g* formed in the gasket 92 and cylinder head 23 and flows into the water jacket 23*c* on the cylinder head 23 side.

Since the cylinder head 23 is largely tilted forward, the cooling water which has entered the right-hand portion of the water jacket 23*c* on the cylinder head 23 side flows leftwards while undergoing gravity downwards (upwards in FIG. 8), so that the upper portion (lower portion in FIG. 8) on the left-hand side of the water jacket 23*c* is apt to be deficient in cooling water.

In the cylinder head 23, however, since the cooling water outlet 93 is disposed in the highest corner portion on the left-hand side of the water jacket 23*c*, the cooling water incoming from the right-hand side flows so as to substantially fill the water jacket 23*c* and thereafter flows out from the cooling water outlet 93 formed in the upper portion on the left-hand side, whereby the whole of the ceiling wall 23*b* which defines combustion chambers in the cylinder head 23 can be cooled substantially uniformly.

But there still is the possibility that a left-hand upper portion close to the central part of the water jacket 23*c* may become deficient in the flow of cooling water. In view of this point the cylinder head 23 is provided with the flow controlling wall 95 to conduct cooling water between the flow controlling wall and an outer wall on the upper side of the cylinder head 23, thereby compensating for the deficiency of cooling water.

Further, since the auxiliary communication hole 23*h* is formed in the lower portion on the left-hand side of the water jacket 23*c*, thereby allowing cooling water to not lose power to flow into the water jacket 23*c* directly from the water jacket 22*c* of the cylinder block 22, the flow of cooling water in the lower portion on the left-hand side of the water jacket 23*c*, which is apt to stay there, can be improved to keep the cooling effect high.

The foregoing position of the cooling water outlet 93 and the presence of the flow controlling wall 95 and auxiliary communication hole 23*h* permit the cooling water to flow uniformly without stagnation so as to reach every corner in the water jacket 23*c*, thereby making it possible to cool all of the cylinder head 23 efficiently.

Moreover, the air vent holes 92*e* and 23*i* are formed in upper positions of the gasket 92 and the ceiling wall 23*b* of the cylinder head 23, respectively, to vent air present within the water jacket 23*c* of the cylinder block 22.

Additionally, the flow controlling wall 95 which controls the flow of cooling water leftwards can enhance the rigidity in the right and left direction of the cylinder block 23.

Figure 9:
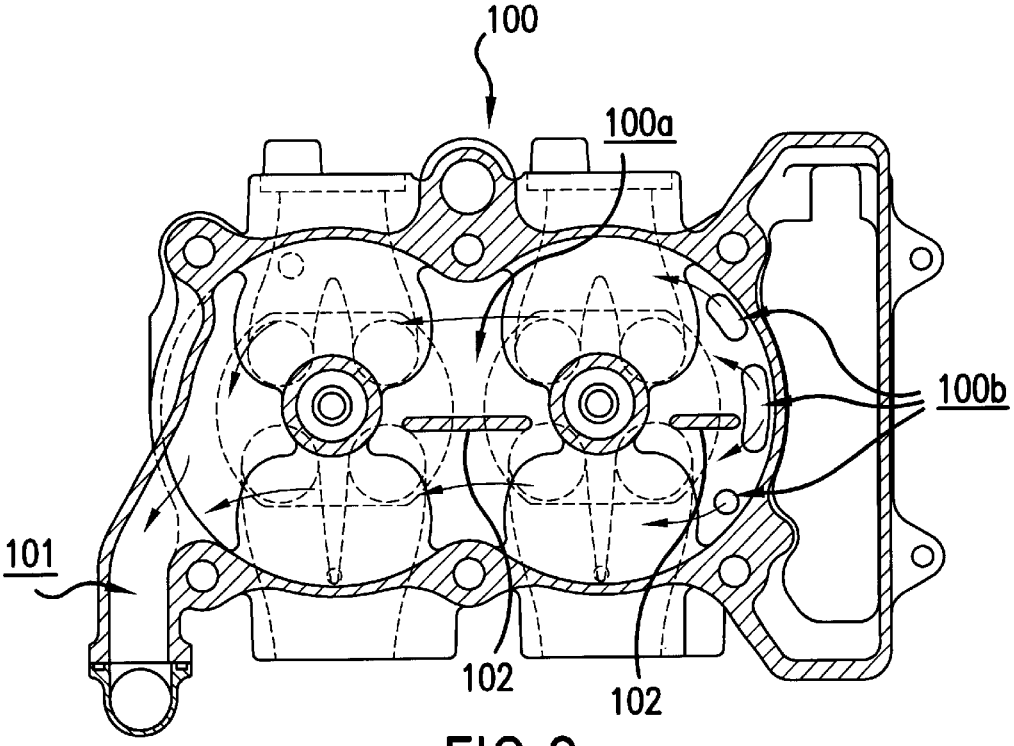
FIG. 9 is a sectional view of another cylinder head.

Referring now to FIG. 9, there is illustrated a cylinder head according to a modification. This cylinder head, indicated at 100, has about the same structure as the structure of the cylinder head 23, but a cooling water outlet 101 and flow controlling walls 102 used in the cylinder head 100 are different from those used in the cylinder head 23.

More specifically, the cooling water outlet 101 is open from a central part on the left-hand side of a water jacket 100*a* up to an upper portion (a lower portion in the figure) and extends upwardly (downwardly in FIG. 9).

Therefore, cooling water after flowing through a left lower portion of the water jacket 100*a* is easy to flow toward the cooling water outlet 101 without stagnation.

The flow controlling walls 102 are each formed in a flat plate shape at both central and right-hand positions of the water jacket 100*a* and extend in the right and left direction which is the crank shaft direction.

Consequently, cooling water incoming from right-hand communication paths 100*b* flows leftwards and prevails throughout whole while it is prevented as far as possible by the flow controlling wall 102 from being localized downwardly, thus making it possible to cool all of the cylinder head 100 efficiently.

In connection with the cylinder head 100 having the cooling water outlet 101 there may be adopted a modification wherein the flow controlling wall 102 is omitted, an auxiliary communication path is formed in a left lower portion (left upper portion in FIG. 9) of the water jacket 100*a*, and air vent holes are also provided.

Figure 10:
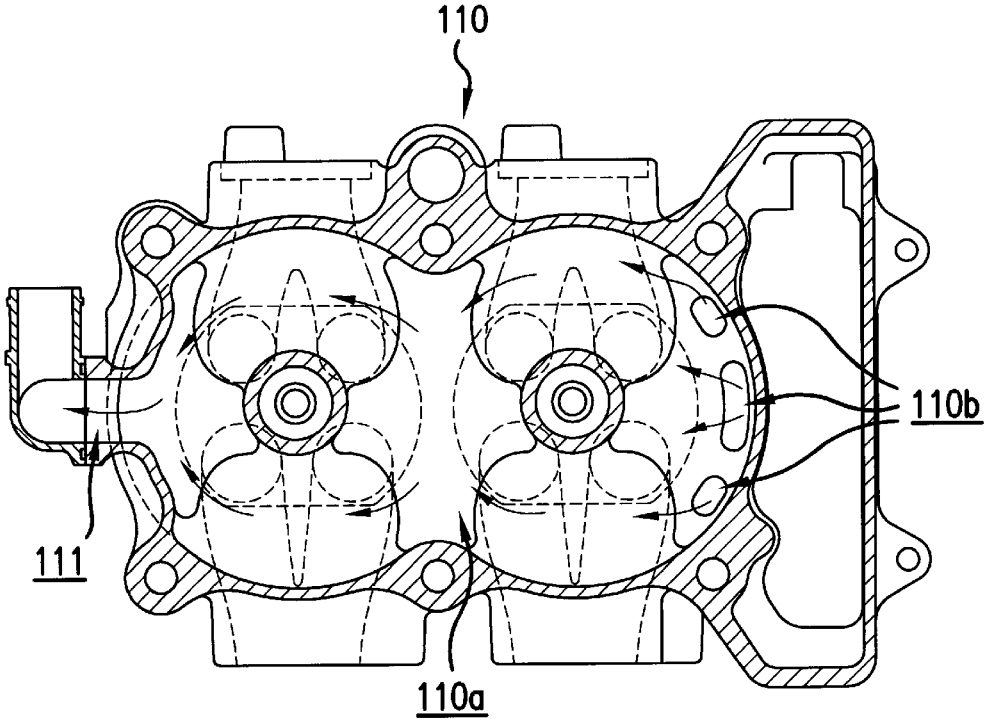
FIG. 10 is a sectional view of a still another cylinder head.
Figure 11:
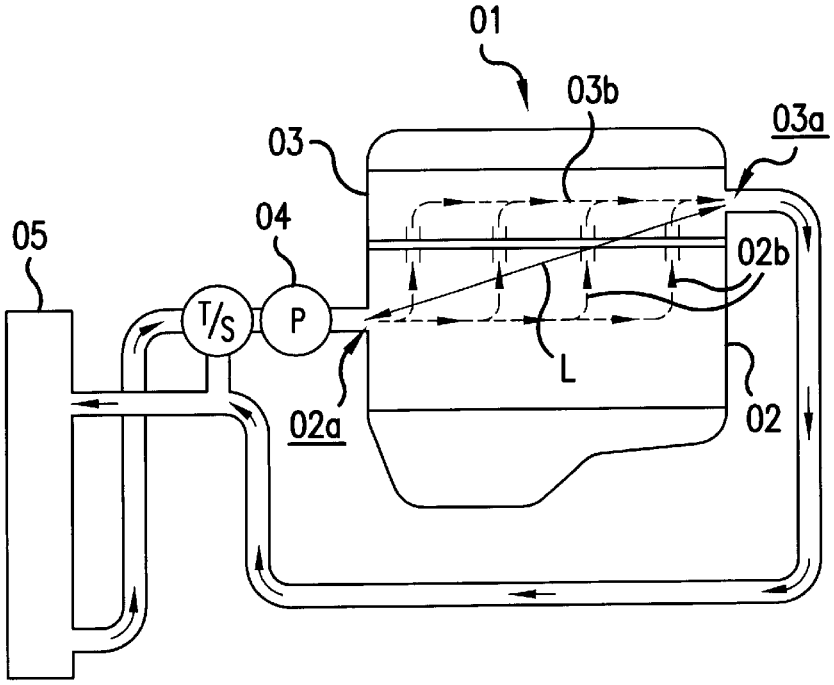
FIG.11 PRIOR ART
FIG. 11 illustrates a conventional cooling water circulating structure.

Referring now to FIG. 10, there is illustrate a cylinder head according to another modification. This cylinder head, indicated at 110, is applied to an internal combustion engine wherein cylinders are not so largely tilted forward. A cooling water outlet 111 is formed in a central part on the left-hand side of a water jacket 110*a*, and a flow controlling wall is not provided.

Since cylinders are not tilted forward, cooling water incoming from communication paths 110*b* flows leftwards while spreading substantially uniformly to cool the whole of the cylinder head 110 efficiently and thereafter flows out from the cooling water outlet 111.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling water circulating structure in an internal combustion engine, comprising:

a cooling water inlet and a cooling water outlet formed side by side in a side face of a cylinder block and a side face of a cylinder head, respectively, in a multi-cylinder type internal combustion engine, both said side faces lying on the same side of the internal combustion engine in close proximity to a water pump;

a cylinder block-side water jacket and a cylinder head-side water jacket in communication with each other through a communication path formed on the side opposite to said side close to the water pump, thereby allowing cooling water to circulate; and an auxiliary communications path located on the same side as the water pump for communicating between the cylinder block-side water jacket and the cylinder head-side water jacket, thus enabling a uniform flow of cooling water throughout the cylinder head-side water jacket.

2. The cooling water circulating structure in an internal combustion engine according to claim 1, wherein cylinders arranged in a crank shaft direction of the multi-cylinder type internal combustion engine are largely tilted forward, and the cooling water outlet is formed in a corner portion located at the highest position of the cylinder head-side water jacket.

3. The cooling water circulating structure in an internal combustion engine according to claim 1, wherein at least one of the cylinder block-side water jacket and the cylinder head-side water jacket is provided with a flow controlling wall for conducting cooling water substantially in a crank shaft direction.

4. The cooling water circulating structure in an internal combustion engine according to claim 2, wherein at least one of the cylinder block-side water jacket and the cylinder head-side water jacket is provided with a flow controlling wall for conducting cooling water substantially in a crank shaft direction.

5. A cooling fluid circulating structure for an internal combustion engine, comprising:

a cylinder block including a side face;

a cylinder head including a side face;

a cooling fluid inlet and a cooling fluid outlet formed side by side in said side face of said cylinder block and said side face of said cylinder head, respectively, in a multi-cylinder type internal combustion engine, both said side face of said cylinder block and said side face of said cylinder head lying on the same side of an internal combustion engine in close proximity to a fluid pump;

a cylinder block-side fluid jacket;

a cylinder head-side fluid jacket; and an auxiliary communication path located on the same side as the fluid pump for communicating between the cylinder block-side fluid jacket and the cylinder head-side fluid jacket, thus enabling a uniform flow of cooling fluid throughout the cylinder head-side fluid jacket;

said cylinder block-side fluid jacket being in communication with said cylinder head-side fluid jacket through a communication path formed on the side opposite to said side close to the fluid pump, thereby allowing cooling fluid to circulate for cooling all parts of said cylinder block and said cylinder head.

6. The cooling fluid circulating structure in an internal combustion engine according to claim 5, wherein cylinders arranged in a crank shaft direction of the multi-cylinder type internal combustion engine are largely tilted forward, and the cooling fluid outlet is formed in a corner portion located at the highest position of the cylinder head-side fluid jacket.

7. The cooling fluid circulating structure in an internal combustion engine according to claim 5, wherein at least one of the cylinder block-side fluid jacket and the cylinder head-side fluid jacket is provided with a flow controlling wall for conducting cooling fluid substantially in a crank shaft direction.

8. The cooling fluid circulating structure in an internal combustion engine according to claim 6, wherein at least one of the cylinder block-side fluid jacket and the cylinder head-side fluid jacket is provided with a flow controlling wall for conducting cooling fluid substantially in a crank shaft direction.

* * * * *